United States Patent [19]

Robertson

[11] Patent Number: 4,494,262

[45] Date of Patent: Jan. 22, 1985

[54] WATERBED MATTRESS COVER

[76] Inventor: Carl L. Robertson, 3104 Carlton Way, Oklahoma City, Okla. 73120

[21] Appl. No.: 488,026

[22] Filed: Apr. 25, 1983

[51] Int. Cl.[3] ..... A47G 9/00

[52] U.S. Cl. ..... 5/451; 5/496; 5/498

[58] Field of Search ..... 5/496, 498, 451, 452, 5/449, 497, 450, 482

[56] References Cited

U.S. PATENT DOCUMENTS

| | | | |
|---|---|---|---|
| 2,630,588 | 3/1953 | Levin | 5/496 |
| 3,066,323 | 12/1962 | Kintner | 5/496 |
| 4,040,133 | 8/1977 | Gilreath | 5/500 |
| 4,045,832 | 9/1977 | Diforti et al. | 5/496 |

*Primary Examiner*—Alexander Grosz
*Attorney, Agent, or Firm*—William R. Laney

[57] ABSTRACT

A mattress cover for use on, and in combination with, a waterbed, including a rectangular fabric panel dimensioned to be longer and wider than the sleeping surface of the waterbed, and having a notch removed from at least two of the corners of the panel at one of the sides of the panel. Elastomeric retainer bands extend across each of these notches and each band has its opposite ends connected to parts of the panel on opposite sides of the respective notch. When the cover is used in combination with a waterbed of right parallelepiped configuration, the panel is superimposed on the upwardly facing sleeping surface of the waterbed, with the peripheral edge portion of the panel overhanging the sides, head and foot of the waterbed, and with the notches in the pad located at corresponding corners of the waterbed. The elastomeric retainer bands extend across the corner edges of the waterbed to hold the mattress cover in position while elastically accommodating expansion and contraction of the waterbed due to water displacement.

7 Claims, 2 Drawing Figures

WATERBED MATTRESS COVER

FIELD OF THE INVENTION

This invention relates to flexible mattress covers for waterbeds.

BACKGROUND OF THE INVENTION

Waterbeds are being purchased and used with increasing frequency. In the construction of a waterbed, a plastic bag of right parallelepiped configuration is filled with water. A person using the waterbed reclines upon an upwardly facing sleeping surface, and is buoyantly supported by the water contained within the plastic bag. As the weight of the body is supported by the waterbed, the water within the bag is displaced, and must be accommodated in such displacement by the plastic cover. Due to the displacement of the water from a central location in the waterbed at a time when a person sleeps or rests thereon, some portion of the plastic bag containing the water must be able to expand sufficiently to accommodate the displaced volume of water. Such expansion occurs, inter alia, at the corners of the waterbed, causing the corners to project slightly farther outwardly from the center of the waterbed than when the waterbed is not in use.

The total weight of the water contained in the plastic bag forming the principle component of a waterbed is quite large. In some cases, over 1,000 pounds of water is contained in the waterbed. This prevents the corners of the waterbed from being easily lifted when making up the bed by placing the conventional bed covers thereon. Thus, it is difficult to place a mattress cover on the waterbed by tucking portions of the cover in under the water-containing bag. It is also difficult, with contour sheets or a contoured or corner pocket-type mattress cover, to lift the corners of the waterbed adequately to permit the mattress cover or contoured sheets to be fitted thereto in conventional fashion.

The present invention provides a novel mattress cover for use on, and in combination with, a waterbed. The mattress cover of the invention accommodates expansion and contraction occurring at the corners of the waterbed without displacement or stressing of the mattress cover, and also permits the matress cover to be quickly and easily secured to the waterbed without the necessity of lifting the corners to place a mattress cover pocket there around, or to tuck edge portions of the mattress cover beneath the waterbed.

Broadly described, the waterbed mattress cover of the present invention comprises a large rectangular panel which is dimensioned to be longer and wider than the upwardly facing sleeping surface of the right parallelepiped waterbed. The mattress cover panel thus has skirts at the top and bottom (or head and foot), as well as at the sides of the panel, which overlap, and will hang down along the sides of the waterbed. At two or more corners of the mattress cover panel, notches are cut from the intersecting sides of the panel at the respective corner. Preferably, such notches are cut at all four corners of the mattress cover panel, with the notches being of rectangular configuration. Stated differently, the preferred form of the notches which are formed at the corners of the mattress cover panel in such that two cuts are made inwardly from the intersecting sides of the panel at right angles to each other, so that a rectangular opening notch or recess is formed at that corner.

At each of the corners of the mattress cover panel where one of the described notches is formed, an elastomeric retainer band is extended across the notch at a location relatively close to the side edges of the panel, and such retainer bands have their opposite ends secured to portions of the panel at opposite sides of the notches. The ends of the respective bands are secured to the panel fabric well inwardly from the cut lines which define opposite sides of the respective notch.

With the notches formed in the manner described and the elastomeric retainer bands secured across these notches, the mattress cover panel is then placed upon the waterbed so that it is superimposed on the upwardly facing sleeping surface of the waterbed. The corners of the panel are then arranged so that the opposed side edges of the notches which have been formed at at least two of the corners are placed in juxtaposition to each other as a result of the elastic retainer bands pulling these edges toward each other. The retainer bands, thus extended across the corner edges of the waterbed, apply tension to the overlapping side portions of the mattress cover panel to retain it alongside, and in close proximity to, the sides, head and foot of the waterbed.

This construction facilitates secure placement of the mattress cover on the waterbed without the necessity of lifting the heavy corners of the waterbed. Moreover, the elastic retainer bands accommodate expansion and contraction of the waterbed without displacement of the mattress cover, and without causing it to skew or become misaligned.

From the foregoing description of the present invention, it will be perceived that the mattress cover of the invention facilitates quick and easy installation on a waterbed, and assures that the cover will remain neatly in place on the waterbed over extended periods of usage.

An important object of the invention is to provide a form-fitting mattress cover for a waterbed which can be quickly placed in position without the necessity for lifting the corners of the waterbed.

A further object of the invention is to provide a mattress cover for a waterbed which remains in proper position, despite expansion and contraction of the waterbed at its corners.

Additional objects and advantages of the invention will become apparent as the following detailed description of preferred embodiments of the invention is read in conjunction with the accompanying drawings which illustrate such preferred embodiments.

GENERAL DESCRIPTION OF THE DRAWINGS

DETAILED DESCRIPTION OF A PREFERRED EMBODIMENT OF THE INVENTION

Figure 1:
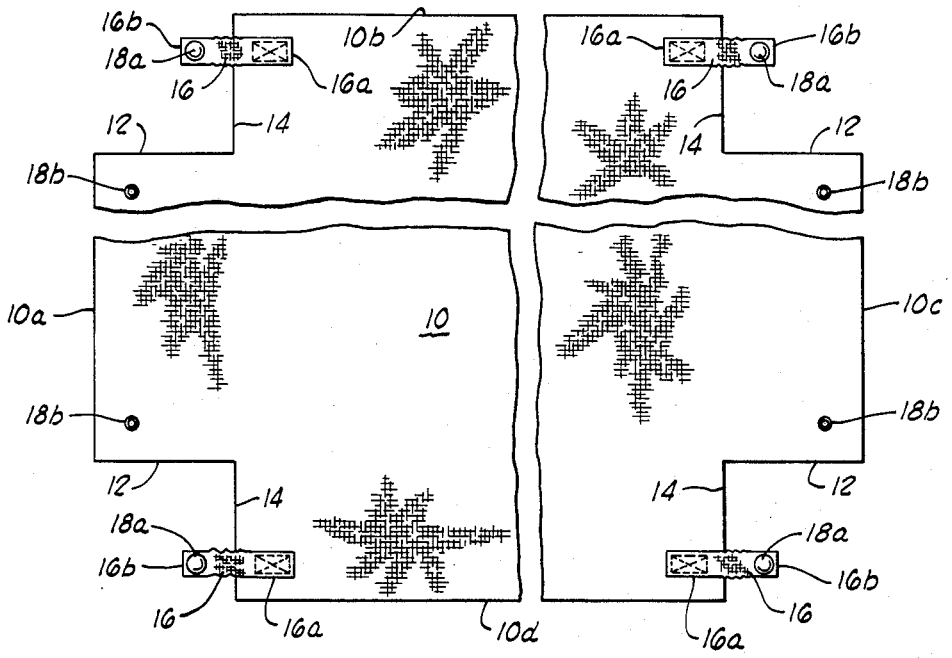
FIG. 1 is a plan view of a mattress cover constructed in accordance with one embodiment of the invention.

Referring initially to FIG. 1 of the drawings, the mattress cover of the invention comprises a rectangular panel 10 of a flexible fabric. Preferably, the panel is constructed of a polyester material. The panel 10 has a width and length dimension such that the width of the panel will be from eight to twelve inches greater than the width of the upwardly facing sleeping surface of the waterbed upon which the mattress cover is to be mounted. The length of the panel 10 will also be from eight to twelve inches greater than the length of the sleeping surface of the waterbed. The opposite side edges of the panel are referred to by reference numerals 10*d* and 10*b*, and the opposite end edges are referred to by reference numerals 10*c* and 10*a*.

In a preferred embodiment of the invention, notches are formed at each of the four corners of the panel by removing rectangular pieces of the panel at that location. Each of the rectangular notches includes a first side 12 which extends normal to one of the long side edges of the panel, and a second side edge 14 which extends normal to one of the short end edges of the panel. The length of the respective side edges of the notches cut at the corners of the panel 10 will correspond to one-half of the distance by which the respective width or length of the panel exceeds the corresponding width or length of the upwardly facing sleeping surface of the waterbed. Thus, for example, if the width of the panel 10 exceeds the width of the sleeping surface of the waterbed by eight inches, the length of the side edge 12 of the each rectangular notch will be four inches. Correspondingly, if, for example, the length of the panel 10 exceeds the length of the upwardly facing sleeping surface of the waterbed by twelve inches, the length of the side edge 14 will be six inches. Thus, in the example described, the dimensions of the rectangular notch cut in each corner will typically be four inches by six inches. Where the amount by which the mattress cover panel overlaps the sides and ends of the sleeping surface of the waterbed is the same, then the shape of the notches cut in each of the corners of the panel will be square.

At each of the notches formed at two or more corners of the mattress cover panel 10, the flexible elastomeric retainer band 16 is secured to the mattress cover panel. Each band 16 has a first end 16*a* which is stitched or sewn to the panel 10 at a location which is spaced inwardly from one of the side edges 12 or 14 of the respective notch by a distance of from one to four inches. The second end 16*b* of each retainer band 16 is adapted to be secured to the panel 10 at a location adjacent the side edge 12 or 14 of the notch which is opposite the side edge nearest the point of securement of the first end 16*a* of the band. Thus, the end 16*b* of the band illustrated in the embodiment of the invention depicted in FIG. 1 carries a snap-fastener element 18*a* which is adapted to snappingly engage a cooperating snap element 18*b* which is sewn or otherwise suitably secured to the panel 10 at the illustrated location. The snap-fastener element 18*b* is preferably located from one to four inches inwardly from the side edge 12 of the notch.

The points of securement of opposite ends of the retainer bands 16 are preferably located relatively near to the respective side and end edges of the mattress cover 10, rather than near the intersection of the edges which define the corner notches. Preferably, the ends of the retainer bands 16 are located from one to three inches from the respective side edges 10*a* and 10*b* and end edges 10*c* and 10*d*, respectively, of the panel 10. Affixation of the retainer band ends at these locations will assure that firm engagement of the elastomeric retainer bands with a corner of the waterbed bag, hereinafter described, will be achieved.

Other means of securement of the opposite ends 16*a* and 16*b* of the retainer bands 16 can be employed, in contrast to those which have been illustrated and described. Thus, each of the opposite ends 16*a* and 16*b* can be secured to the appropriate points on the panel 10 by means of snap fasteners so that the entire retainer bands may be detached, if desired, or the same general type of attachment might be achieved with hook and loop type fasteners such as the and sold under the trademark of Velcro. In a preferred embodiment of the invention, however, each elastomeric retainer band 16 has each of the opposite ends 16*a* and 16*b* sewn or stitched to the described points of securement on the panel 10, and this preferred method of securement characterizes the embodiment of the mattress cover illustrated in FIG. 2 of the drawings.

Figure 2:
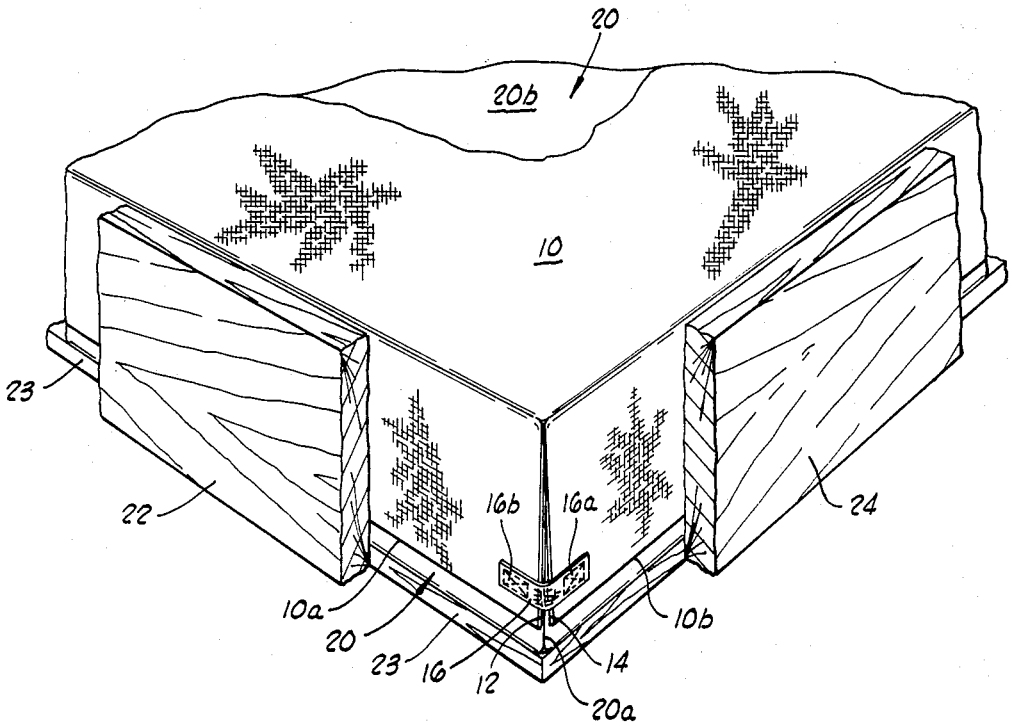
FIG. 2 is a perspective view of one corner portion of a waterbed having the mattress cover of the present invention installed thereon, and illustrating a modified embodiment of the mattress cover of the invention.

In FIG. 2 of the drawings, the mattress cover of the invention is shown assembled upon a waterbed. The waterbed includes a water containing plastic bag 20 of right parallelepiped configuration. The bag 20 thus has four right angular corners 20*a* and includes an upwardly facing sleeping surface 20*b*. The water containing bag 20 is rested upon a suitable supporting structure 23, and is confined at its opposite sides and ends by a plurality of frame members 22 and 24.

When the mattress cover of the invention is placed in position on the waterbed, the panel 10 is superimposed upon the upwardly facing sleeping surface 20*b* of the water confining bag 20, and the peripheral portions of the panel are turned down along the sides and ends of the right parallelepiped bag. When this is done, the elastomeric retainer bands 16 contract and draw the opposite side edges 12 and 14 which define the notches at the corners of the panel into close proximity to each other, and into substantial parallelism along the corner edges 20*a* of the water confining bag 20. This status of the mattress cover is illustrated in FIG. 2.

When the mattress cover 10 is positioned on the waterbed as shown in FIG. 2, the elastomeric retainer bands 16 function to hold the cover in a stretched, neat status on the bag 20. When a person reclines on the waterbed, the water is displaced toward the sides and corners of the bag 20. The bag 20 thus tends to expand in these directions, and the corners 20*a* tend to protrude outwardly slightly further than when there is no weight upon the bag. This outward movement of the corners 20*a* of the bag 20 is accommodated by the elastomeric retainer bands 16.

It will be perceived that by the use of the mattress cover of the invention, it is unnecessary to lift the heavy corners 20*a* of the water-filled bag 20 in order to tuck a pocket or retainer strap underneath the corners of the bag to hold the mattress cover 10 in position. Moreover, the specific location of the elastomeric retainer bands 16 accommodates expansion of the water-filled bag 20. The bands 16 also function, quite effectively, to hold the peripheral portions of the mattress cover panel 10 down alongside the vertically extending side and end faces of the bag 20 without the need to tuck the edges of the panel underneath the bag by lifting portions of the bag upwardly.

Although certain perferred embodiments of the invention have been herein described in order to illustrate the principles of the invention, it will be understood that various changes can be made in the illustrated and described structures without departure from these basic principles, and while still within the broad novel concepts of the invention. Changes and innovations of this type are deemed to be circumscribed by the spirit and scope of the invention except as the same may be necessarily limited by the appended claims or reasonable equivalents thereof.

What is claimed is:

1. A mattress cover for a waterbed mattress comprising:

a flexible fabric panel of rectangular configuration and having four rectangularly notched corners at each corner of the panel, the notching at each corner of the panel being rectangular in shape and formed by intersecting cuts projecting inwardly from, and normal to, two intersecting sides of the rectangular fabric panel; and an elastomeric retainer band extending across each of the notches at each corner of the panel, and each of said bands having its opposite ends connected to parts of the panel on opposite sides of the respective rectangular notch, each of said bands projecting normal to the sides of the notch and functioning to elastomerically draw said notch sides into parallelism and adjacent to each other when said flexible fabric panel is placed on a waterbed mattress with the notches at each of corners of the mattress.

2. A mattress cover for a waterbed as defined in claim 1 wherein each of said bands has its opposite ends stitched to parts of the panel on opposite sides of the respective notch.

3. A mattress cover for a waterbed as defined in claim 1 wherein one of the ends of each of said retainer bands is quick-detachably connected to the panel on one side of the respective notch.

4. A waterbed assembly comprising:

a flexible, resilient liquid containing bag of right parallelepiped configuration, and including an upwardly facing sleeping surface;

a rigid frame supporting said bag; and a mattress cover covering the sleeping surface of the bag and including a flexible fabric panel having a pair of opposed side edges and a pair of opposed end edges, said panel being wider and longer between said side edges and end edges, respectively, than the respective width and length of said upwardly facing sleeping surface whereby side and end portions of said panel overhang the sides and ends of said bag, said panel further including a notch at each of the four corners of the panel cut from the panel by cutting inwardly along intersecting lines extending normal to two intersecting sides of the panel so that each of the notches is rectangular in configuration; and an elastomeric retainer band extending across each of said notches and tensioned directly across a corner of said bag, each of said bands having its opposed ends secured to said panel at locations spaced from the edges of the panel defining the respective notch across which the respective band extends, and each of said bands extending normal to the side edges of the notch along which the notch has been cut from the panel and functioning to draw the side edges of the respective notch into parallelism and close proximity to each other at the respective corner of said flexible bag where said notch is located.

5. A waterbed assembly as defined in claim 4 wherein said frame includes frame members at the side of, and laterally confining, the bag.

6. A waterbed assembly as defined in claim 4 wherein each of said bands has its opposite ends stitched to parts of the panel on opposite sides of the respective notch across which it extends.

7. A waterbed assembly as defined in claim 6 wherein each of said bands has one of its ends connected to the panel part on one side of the respective notch at a location which is not more than three inches inwardly from the nearest side of the panel.

* * * * *